US008211372B2

(12) United States Patent
Jung et al.

(10) Patent No.: US 8,211,372 B2
(45) Date of Patent: Jul. 3, 2012

(54) SYSTEM AND APPARATUS OF SEPARATING REMAINING POWDER OF HULL

(75) Inventors: Jae-Hoo Jung, Daejeon (KR); Young-Hwan Kim, Daejeon (KR); Byung-Suk Park, Daejeon (KR); Ki Ho Kim, Daejeon (KR); Ji Sup Yoon, Daejeon (KR); Sung-Hyun Kim, Daejeon (KR); Hyo Jik Lee, Daejeon (KR)

(73) Assignees: Korea Hydro & Nuclear Power Co., Ltd., Seoul (KR); Korea Atomic Energy Research Institute, Daejon (KR)

( * ) Notice: Subject to any disclaimer, the term of this patent is extended or adjusted under 35 U.S.C. 154(b) by 305 days.

(21) Appl. No.: 12/708,239

(22) Filed: Feb. 18, 2010

(65) Prior Publication Data

US 2010/0272616 A1 Oct. 28, 2010

(30) Foreign Application Priority Data

Apr. 27, 2009 (KR) ..... 10-2009-0036611

(51) Int. Cl.
*G21C 1/00* (2006.01)
*G21F 9/00* (2006.01)

(52) U.S. Cl. ..... 422/159; 422/255; 422/286; 422/903; 588/1; 588/18

(58) Field of Classification Search ..... 422/159, 422/255, 286, 903; 588/1, 18
See application file for complete search history.

(56) References Cited

U.S. PATENT DOCUMENTS 7,143,963 B2 * 12/2006 Tani et al. ..... 239/456
7,673,544 B2 * 3/2010 Jung et al. ..... 83/102

* cited by examiner

*Primary Examiner* — Walter D Griffin
*Assistant Examiner* — Lessanework Seifu
(74) *Attorney, Agent, or Firm* — Brinks Hofer Gilson & Lione

(57) ABSTRACT

An apparatus and system for separating remaining powder of hulls includes a first remaining powder separating unit to be supplied with hulls of a spent nuclear fuel subjected to a high-temperature oxidation, and to include a first brush for separating remaining powder of the hulls; a hull alignment unit to be supplied with the hulls from the first remaining powder separating unit, and to align the hulls; a second remaining powder separating unit to be supplied with the aligned hulls from the hull alignment unit, and to include a second brush for separating remaining powder adhered on an inner peripheral surface of the hulls; and a third remaining powder separating unit to be supplied with the hulls from the second remaining powder separating unit, and to separate the remaining powder remaining on the inner/outer peripheral surface of the hulls by using air.

8 Claims, 4 Drawing Sheets

SYSTEM AND APPARATUS OF SEPARATING REMAINING POWDER OF HULL

CROSS-REFERENCE TO RELATED APPLICATION

This application claims priority from Korean Patent Application No. 10-2009-0036611, filed on Apr. 27, 2009, in the Korean Intellectual Property Office, the entire disclosure of which is incorporated herein by reference.

BACKGROUND

1. Technical Field

The present disclosure relates to an apparatus and system for separating remaining powder of hulls, and more particularly, to an apparatus and system for separating remaining powder of hulls, which may collect remaining powder remaining on hulls of a spent nuclear fuel that is separated into the hulls and pellet powder by a high-temperature oxidation process.

2. Related Art

A nuclear fuel may designate substances by which available energy is obtained such that the nuclear fuel is charged into a nuclear reactor to create a nuclear fission chain reaction, and a spent nuclear fuel may designate remaining substances after creating the nuclear fission chain reaction.

There are two management methods for the spent nuclear fuel as follows. One is a method in which the spent nuclear fuel is embedded below a rock bed of an underground having a depth of 500 m or more to thereby completely isolate the spent nuclear fuel from a human ecology, which is referred to as 'permanent disposal'. The other is a method in which recyclable substances are separated from a spent nuclear fuel, so that nuclear fuel substances are re-used and high radioactive wastes are permanently disposed.

In these conventional methods, spent nuclear fuels having been ignited in a nuclear power plant may be deposited and stored in a water tank in a state where a supplementary treatment for the ignited spent nuclear fuels is no longer carried out, however, an amount of spent nuclear fuel rods may be gradually accumulated with an increase in a period during which a nuclear power is operated, and thus a huge storage space may be required. Also, needs and risks in managing and processing accumulated nuclear wastes may arise.

Accordingly, a development in management technologies for recycle of the spent nuclear fuel having a solid type may be urgently required. In this regard, a partial process apparatus for powdering/oxidizing the spent nuclear fuel and transmitting the oxidized nuclear fuel to subsequent processes has been developed.

There is a need for separating and recovering remaining powder remaining on hulls even after the spent nuclear fuel is separated into the hulls and pellet powder by a high oxidation process.

SUMMARY

An aspect of the present disclosure provides an apparatus and system of separating remaining powder of hulls, which may separate remaining powder from hulls obtained by a high-temperature oxidation process.

Another aspect of the present disclosure also provides an apparatus and system of separating remaining powder of hulls, which may separate remaining powder from the hulls in several times, thereby increasing a degree of recovery of the remaining powder.

Still another aspect of the present disclosure also provides an apparatus and system of separating remaining powder of hulls, which may respectively receive hulls and the remaining powder being automatically separated.

According to an aspect of the present disclosure, there is provided an apparatus of separating remaining powder of hulls, including: a first remaining powder separating unit, a hull alignment unit, a second remaining powder separating unit, and a third remaining powder separating unit.

In this instance, the apparatus may further include a hull receiving unit to receive the hulls transported from the third remaining powder separating unit, and a remaining powder receiving unit to receive the separated remaining powder from the hulls. Also, the remaining powder receiving unit may be positioned in a lower portion of the second remaining powder separating unit or of the third remaining powder receiving unit.

Also, the first remaining powder separating unit may be supplied with hulls of a spent nuclear fuel subjected to a high-temperature oxidation, and may include a first brush for separating remaining powder adhered on an outer peripheral surface of the hulls. Also, the first remaining powder separating unit may include a charging port where the hulls are charged, the charging port being formed in an upper portion of the first remaining powder separating unit, and a discharging port where the hulls are discharged, the discharging port being formed in a lower portion of the first remaining powder separating unit, and the discharging port being selectively opened and closed.

Also, the hull alignment unit may be a parts feeder for aligning the hulls by using vibration.

Also, a second remaining powder separating unit may be supplied with the aligned hulls from the hull alignment unit, and may include a second brush for separating remaining powder adhered on an inner peripheral surface of the hulls. Also, the second remaining powder separating unit may include a clamp for fixing the hulls, and two second brushes may be inserted into each of the hulls to separate the remaining powder.

Also, a third remaining powder separating unit may be supplied with the hulls from the second remaining powder separating unit, and may separate the remaining powder remaining on the inner/outer peripheral surface of the hulls by using air.

Also, the apparatus may further include a counting unit to determine a quantity of hulls. In this instance, the counting unit may be an optical sensor positioned on a movement path of the hulls.

According to an aspect of the present disclosure, there is provided a system of separating remaining powder of hulls, the system including: an oxidation unit to powder and separate a pellet of hulls of a spent nuclear fuel subjected to a high-temperature oxidation; a first remaining powder separating unit to be supplied with the hulls separated in the oxidation unit, and to include a first brush for separating remaining powder adhered on an outer peripheral surface of the hulls; a hull alignment unit to be supplied with the hulls from the first remaining powder separating unit, and to align the hulls; a second remaining powder separating unit to be supplied with the aligned hulls from the hull alignment unit, and to include a second brush for separating remaining powder adhered on an inner peripheral surface of the hulls; a third remaining powder separating unit to be supplied with the hulls from the second remaining powder separating unit, to separate the remaining powder remaining on the inner/outer peripheral surface of the hulls using air; a hull receiving unit to receive the hulls transported from the third remaining powder separating unit; a remaining powder receiving unit to receive the remaining powder separated from the hulls; and a high-temperature vacuum heating unit to be supplied with at least one of the pellet separated in the oxidation unit or the remaining powder received in the remaining powder receiving unit, and to heat the pellet or the remaining powder in a high temperature vacuum.

DESCRIPTION OF THE PREFERRED EMBODIMENTS

Figure 1:
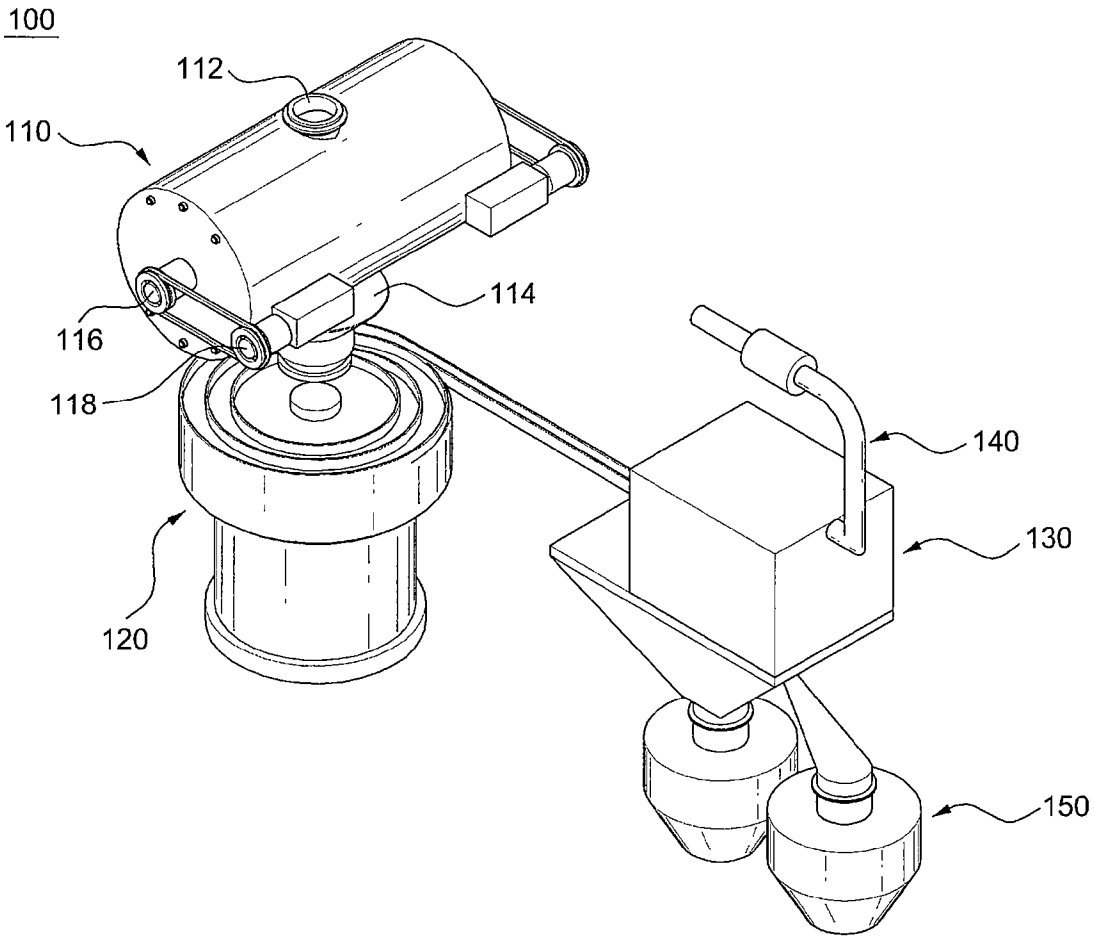
FIG. 1 illustrates a configuration of an apparatus of separating remaining powder of a hull according to an embodiment of the present disclosure.

Reference will now be made in detail to embodiments of the present disclosure, examples of which are illustrated in the accompanying drawings, wherein like reference numerals refer to the like elements throughout. The embodiments are described below in order to explain the present invention by referring to the figures.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

Figure 2:
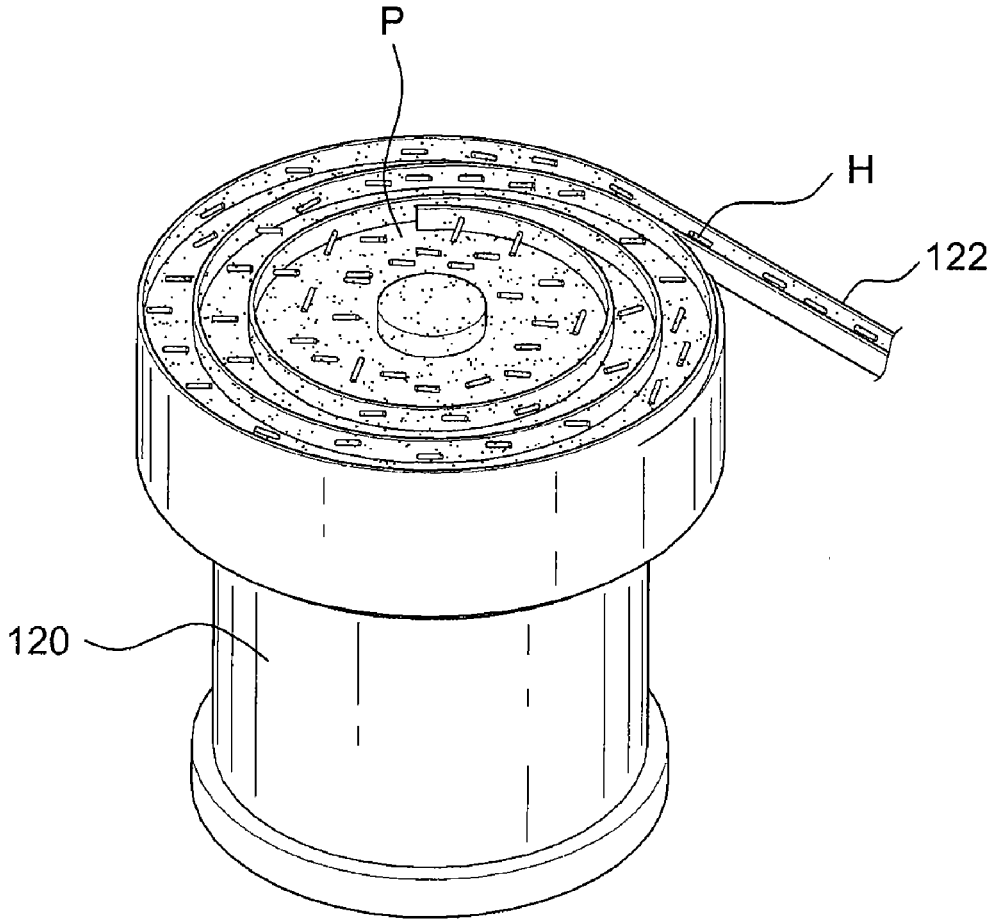
FIG. 2 illustrates a configuration of a hull alignment unit of the apparatus of separating remaining powder of the hull of FIG. 1.
Figure 3:
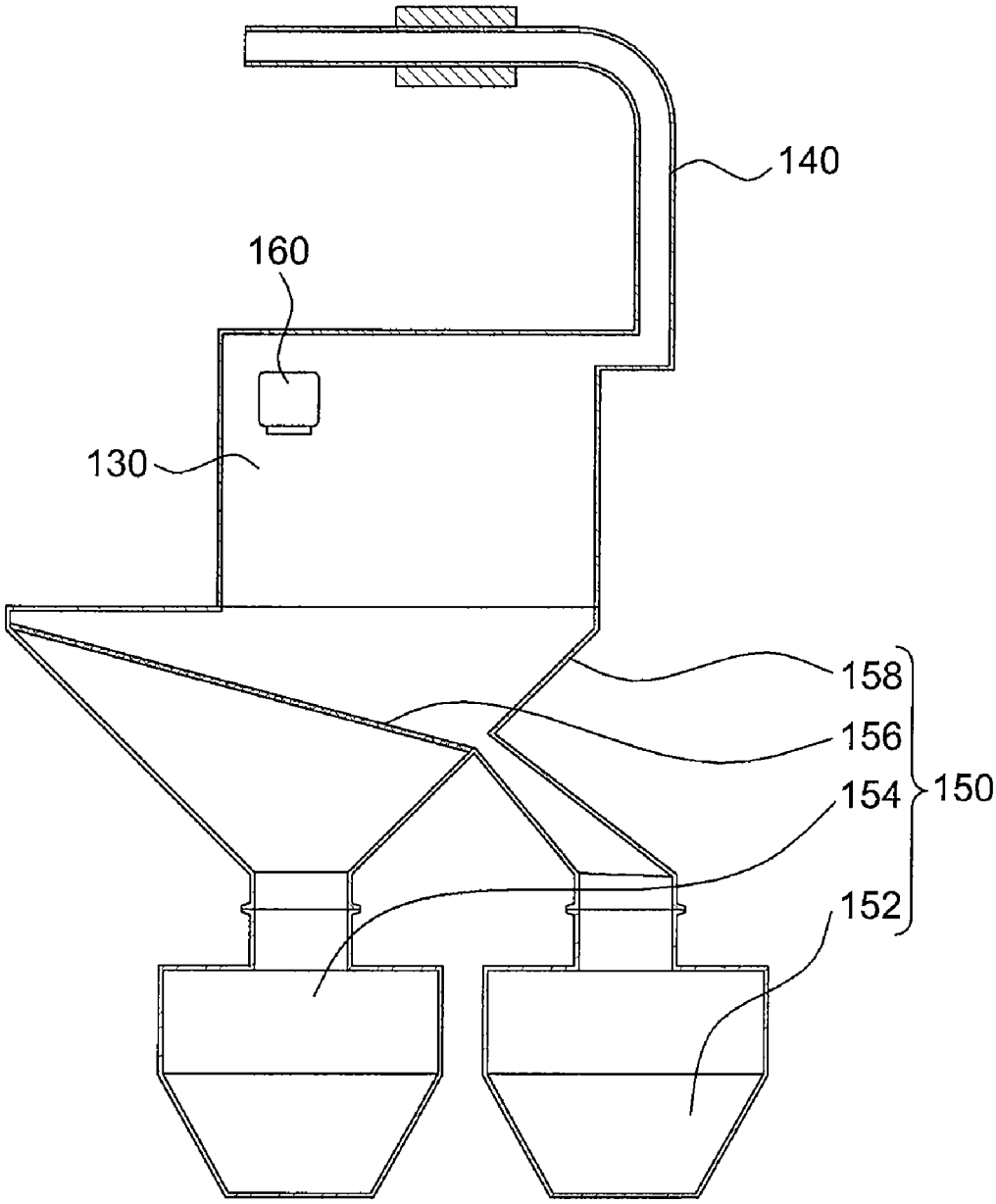
FIG. 3 illustrates a configuration of a second remaining powder separating unit, a third remaining powder separating unit, and a receiving unit of the apparatus of separating remaining powder of the hull of FIG. 1.
Figure 4:
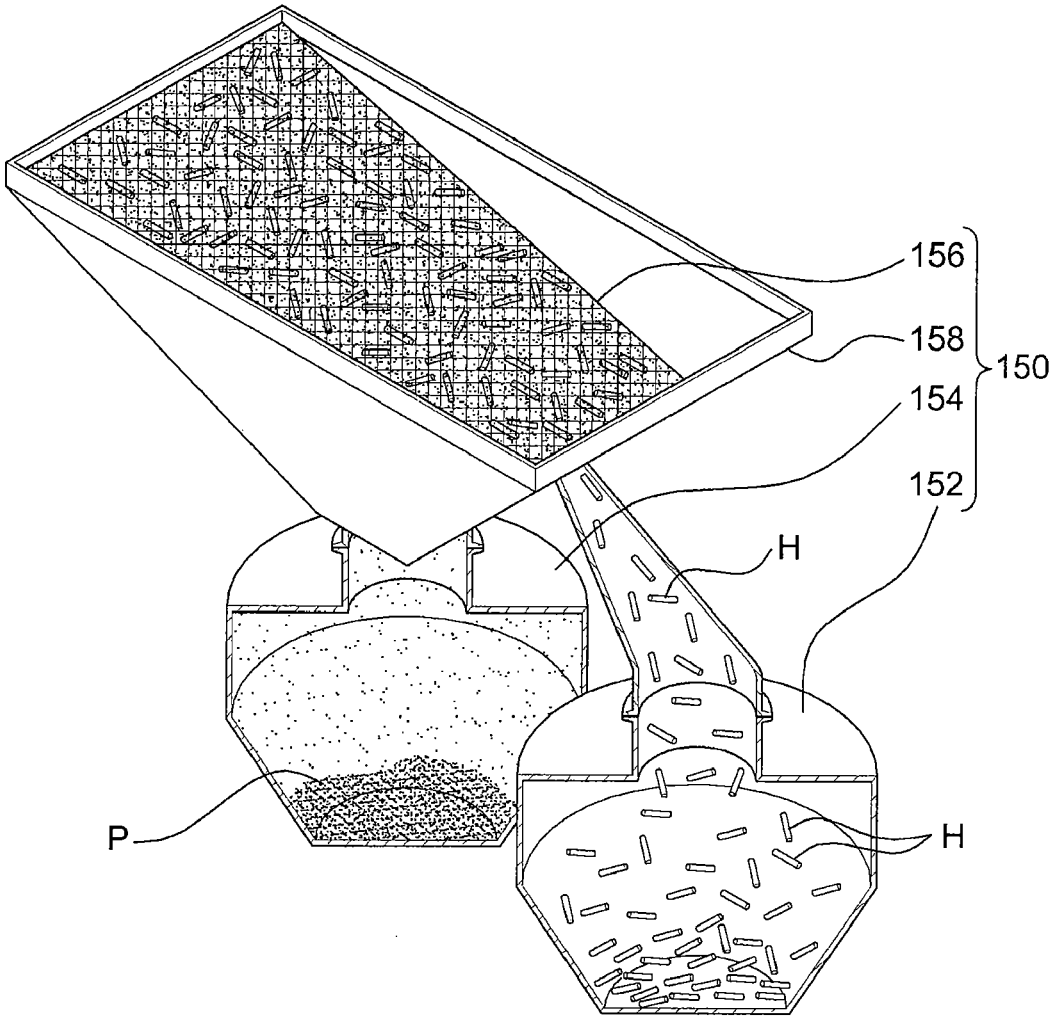
FIG. 4 is a diagram used for describing a hull and remaining powder are separately received in the receiving unit of FIG. 3.

FIG. 1 illustrates a configuration of an apparatus 100 of separating remaining powder of a hull (H) according to embodiment of the present disclosure, FIG. 2 illustrates a configuration of a hull alignment unit of the apparatus 100 of FIG. 1, FIG. 3 illustrates a configuration of a second remaining powder separating unit, a third remaining powder separating unit, and a receiving unit of the apparatus 100 of FIG. 1, and FIG. 4 is a diagram used for describing a hull and remaining powder are separately received in the receiving unit of FIG. 3.

Referring to FIG. 1, the apparatus 100 includes a drum 110 of a first remaining powder separating unit, a parts feeder 120 of a hull alignment unit, a second remaining powder separating unit 130, an air shower 140 of a third remaining powder separating unit, and a receiving unit 150.

The drum 110 may be a cylindrically-shaped hollow vessel. The drum 110 may include a charging port 112 formed in an upper portion thereof. Hulls (H) being cut by a predetermined length may be charged into the charging port 112. In this instance, the charging port 112 may include a cap formed thereon. The cap may be opened when the hulls (H) are charged into the charging port 112, and may be closed when injection of the hulls (H) into the charging port 112 is completed.

The drum 110 may include a brush shaft 116 formed in both ends of the drum 110 in such a manner as to be rotated. In this instance, the brush shaft 116 may be extended to outside the drum 110. The brush shaft 116 may include a power transfer means, such as a belt or a pulley, formed on both end portions thereof. The power transfer means may be connected with a driving motor 118. Accordingly, a rotation power transferred from the driving motor 118 may be transmitted to the brush shaft 116 via the power transfer means to thereby enable the brush shaft 116 to be rotated.

The drum 110 may include a first brush (not illustrated) formed therein. The first brush may be attached on the brush shaft 116 to thereby be rotated inside the drum 110 when the brush shaft 116 is rotated.

When the hulls (H) are charged into the drum 110, and the brush shaft 116 is rotated, the hulls (H) may be rotated together with the first brush. The first brush mounted in the drum 110 may separate remaining powder adhered to an outer peripheral surface of the hull (H).

The drum 110 may include a discharging port 114 formed in a lower portion thereof. The hulls (H) with the separation of the remaining powder adhered to the outer peripheral surface of the hull (H) completed in the drum 110 may be discharged through the discharging port 114. The discharging port 114 may be a knife gate valve that is selectively opened/closed to discharge the hulls (H). That is, when the separation of the remaining powder adhered on the outer peripheral surface of the hull (H) is completed in the drum 110, the knife gate valve of the discharging port 114 may be opened to discharge the hulls (H), and when the hulls (H) are completely discharged out from the drum 110 by their gravity, the knife gate value may be closed.

Referring to FIGS. 1 and 2, the parts feeder 120 of the hull alignment unit may be provided below the discharging port 114. The parts feeder 120 may align the hulls (H) supplied from the drum 110, using a vibration, so that the hulls (H) are aligned in a certain direction and position. The hulls (H) provided to a center portion of the parts feeder 120 may be moved to a rim portion of the parts feeder 120 in a state where the hulls are aligned in the certain direction and position by the vibration. The hulls (H) moved to the rim portion of the parts feeder 120 may be transported to a transportation path 122 formed in an end of the parts feeder 120. In this instance, the hulls (H) transported to the transportation path 122 may be aligned to be readily transported to the second remaining powder separating unit 130.

The transportation path 120 may serve as a path where the hulls (H) aligned in the parts feeder 120 are transported to the second remaining powder separating unit 130, and may transport the hulls (H) in one direction using a conveyor, inclination, or vibration.

Referring to FIGS. 1 and 3, the second remaining powder separating unit 130 connected with the transportation path 122 may include a clamp (not illustrated) for holding the provided hulls (H) and a second brush (not illustrated) for separating remaining powder adhered on an inner peripheral surface of the hull (H).

The hulls (H) transported to the second remaining powder separating unit 130 may be fixed by the clamp, and two second brushes may be inserted into the hull (H) to secondly separate the remaining powder adhered on the inner peripheral surface of the hull (H).

The air shower 140 of the third remaining powder separating unit may be connected with the second remaining powder separating unit 130. The air shower 140 may be externally connected with an air spraying unit (not illustrated) for spraying air to separate the remaining powder of the hull (H).

That is, when the remaining powder adhered on the inner peripheral surface of the hull (H) is completely separated by means of the second brush of the second remaining powder separating unit 130, and the hulls (H) are transported forward, air may be sprayed to the inner/outer peripheral surface of the hull (H) using the air shower 140 to thereby thirdly separate remaining powder remaining on the inner/outer peripheral surface of the hull (H).

The apparatus 100 may include a counting unit to determine a quantity of the hulls (H). As the counting unit, an optical sensor 160 may be used, and the optical sensor may be positioned on a movement path of the hulls (H). According to the present exemplary embodiment, the optical sensor 160 may be disposed between the parts feeder 120 and the second remaining powder separating unit 130 to thereby determine the quantity of the transported hulls (H).

When the above described remaining powder separation process being separated into the hulls (H) and the remaining powder (P) is completed, the separated hulls (H) and the remaining powder (P) may be separately received in the receiving unit 150.

The receiving unit 150 may be positioned under the second remaining powder separating unit 130 and the air shower 140. The receiving unit 150 may include a hull receiving unit 152, a remaining powder receiving unit 154, a mesh 156, and a guidance vessel 158.

The guidance vessel 158 may be a funnel-shaped vessel disposed under the second remaining powder separating unit 130 and the air shower 140. The separated hulls (H) and the remaining powder (P) may be fed to an upper portion of the guidance vessel 158, and may be collected in a lower portion of the guidance vessel 158 by a shape of the guidance vessel 158.

The mesh 156 may be provided in the guidance vessel 158, and disposed to be obliquely inclined in a direction from the parts feeder 120 toward the hull receiving unit 152. The remaining powder (P) may be received in the remaining powder receiving unit 154 passing through the mesh 156, and the hulls (H) may be guided and received in the hull receiving unit 152.

As illustrated in FIG. 4, the remaining powder receiving unit 154 may be disposed under the guidance vessel 158. The remaining powder receiving unit 154 may be detachably mounted to a lower portion of the guidance vessel 158. Accordingly, a cover of the remaining powder receiving unit 154 may be closed when the reception of the remaining powder (P) is completed, and then the received remaining powder (P) may be readily moved to a place where a subsequent process is performed.

The hull receiving unit 152 may be disposed in a side of the guidance vessel 158. An end of the hull receiving unit 152 may be connected with the side of the guidance vessel 158 in a position of being adjacent to an end of the mesh 156. The hull receiving unit 152 may be detachably coupled to the guidance vessel 158. Accordingly, a cover of the hull receiving unit 152 may be closed when the reception of the hulls (P) is completed, and then the received hulls (H) may be readily moved to a place where a subsequent process is performed.

A process of separating the hulls (H) and the remaining powder (P) using the apparatus 100 will be herein described in detail.

First, hulls (H) from which powder is separated by performing a high temperature oxidation process on a spent nuclear fuel may be provided. In this instance, the hulls (H) may be desirably provided to be cut by a predetermined length. More desirably, a length of the hull (H) may be about 5 cm.

Next, the charging port 112 of the drum 110 may be opened, the hulls (H) may be charged into the charging port 112, and then the charging port 112 may be closed. In this instance, the discharging port 114 formed in the lower portion of the drum 110 may be maintained in a state of being closed.

Next, the first brush and the hulls (H) may be rotated together by the driving motor 118. The remaining powder (P) adhered on the outer peripheral surface of the hull (H) may be separated using the first brush formed inside the drum 110.

When the separation of the remaining powder (P) adhered on the outer peripheral surface of the hull (H) is completed, the discharging port 114 may be opened. When a transportation of the hulls (H) to the part feeder 120 is completed, the discharging port 114 may be closed.

Next, the hulls (H) supplied to the parts feeder 120 may be transported to the second remaining powder separating unit 130 while being aligned by vibration.

Next, in the second remaining powder separating unit 130, the hulls (H) may be fixed by the clamp, and two second brushes may be inserted into the hull (H) through both ends of the hull (H) to thereby second separate remaining powder (P) adhered on an inner peripheral surface of the hull (H).

The hulls (H) in which second separation is completed may be moved forward, and remaining powder (P) remaining on the inner/outer peripheral surface of the hull (H) may be third separated from the hull (H) using the air shower 140.

Next, the separated remaining powder (P) may be downwardly dropped to be guided to the guidance vessel 158, and may be received in the remaining powder receiving unit 154 passing through the mesh 156 mounted in the guidance vessel 158.

The separated hulls (H) may be downwardly dropped to the guided to the guidance vessel 158, and may be received in the hull receiving unit 152 along the mesh 156.

Next, when the separation of the hulls (H) and the remaining powder (P) is completed, the separated hulls (H) and remaining powder (P) may be respectively moved to a place where a corresponding subsequent process is performed.

A system of separating remaining powder of a hull according to an exemplary embodiment may include an oxidation unit, a first remaining powder separating unit, a hull alignment unit, a second remaining powder separating unit, a third remaining powder separating unit, a hull receiving unit, a remaining powder receiving unit, and a high-temperature vacuum heating unit.

Configurations of the first remaining powder separating unit, the hull alignment unit, the second remaining powder separating unit, the third remaining powder separating unit, the hull receiving unit, and the remaining powder receiving unit of the system may be similar to those of the drum 110, the parts feeder 120, the second remaining powder separating unit 130, and the air shower 140, and the hull receiving unit 152, and the remaining powder receiving unit 154 of the apparatus 100, and thus descriptions thereof will be omitted.

The oxidation unit may be supplied with a spent nuclear fuel being cut by a predetermined length, and the spent nuclear fuel may be heated at a high-temperature and in a vacuum state using an oxidant and a ceramic ball, and thereby the spent nuclear fuel may be separated into pellet powder and hulls. The separated pellet powder and hulls may be selectively discharged, and the hulls may be transported to the first remaining powder separating unit to separate remaining powder from the hulls.

The hulls and the remaining powder may be separated while passing through the first remaining powder separating unit, the hull alignment unit, the second remaining powder separating unit, the third remaining powder separating unit, the hull receiving unit, and the remaining powder receiving unit, and volatile toxic substances within remaining powder received in the remaining powder receiving unit may be removed by the high-temperature vacuum heating unit.

The high-temperature vacuum heating unit may be supplied with at least one of the pellet separated in the oxidation unit and the remaining powder received in the remaining powder receiving unit, and may heat the pellet or the remaining powder in a high temperature vacuum. Since the volatile toxic substances within the remaining powder heated in the high temperature vacuum in the high-temperature vacuum are removed, treatments for the remaining powder in a subsequent process may be simplified.

As described above, according to the apparatus and the system of separating the remaining powder of the hull, it may be possible to automatically separate remaining powder remaining on the hulls. In particular, the remaining powder remaining on the inner/outer peripheral surface of the hull may be separated from the hull three times, thereby completely separating the remaining powder from the hull.

Also, the remaining powder and the hulls separated by the apparatus and the system may be automatically received in the respective receiving unit, thereby reducing supplementary costs created due to a subsequent process.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. An apparatus for separating remaining powder of hulls, the apparatus comprising:

a first remaining powder separating unit operable to be supplied with hulls of spent nuclear fuel subjected to a high-temperature oxidation, including a first brush for separating remaining powder adhered on an outer peripheral surface of the hulls;

a hull alignment unit operable to be supplied with the hulls from the first remaining powder separating unit, and to align the hulls;

a second remaining powder separating unit operable to be supplied with the aligned hulls from the hull alignment unit, including a second brush for separating remaining powder adhered on an inner peripheral surface of the hulls; and a third remaining powder separating unit operable to be supplied with the hulls from the second remaining powder separating unit, and to separate the remaining powder remaining on the inner/outer peripheral surface of the hulls by using air.

2. The apparatus according to claim 1, further comprising:

a hull receiving unit operable to receive the hulls transported from the third remaining powder separating unit; and a remaining powder receiving unit operable to receive the separated remaining powder from the hulls, wherein the remaining powder receiving unit is positioned in a lower portion of the second remaining powder separating unit or of the third remaining powder receiving unit.

3. The apparatus according to claim 2, wherein the first remaining powder separating unit includes a charging port where the hulls are charged, the charging port being formed in an upper portion of the first remaining powder separating unit, and a discharging port where the hulls are discharged, where the discharging port is formed in a lower portion of the first remaining powder separating unit, and where the discharging port is selectively opened and closed.

4. The apparatus according to claim 2, wherein the hull alignment unit is a parts feeder for aligning the hulls by using vibration.

5. The apparatus according to claim 2, further comprising:

a counting unit to determine a quantity of hulls, wherein the counting unit is an optical sensor positioned on a movement path of the hulls.

6. The apparatus according to claim 2, wherein the second remaining powder separating unit includes a clamp for fixing the hulls and two second brushes operable to be inserted into each of the hulls to separate the remaining powder.

7. The apparatus according to claim 2, wherein the third remaining powder separating unit is an air shower for applying air to the inner/outer peripheral surface of the hulls.

8. A system of separating remaining powder of hulls, the system comprising:

an oxidation unit operable to powder and separate a pellet of hulls of a spent nuclear fuel subjected to a high-temperature oxidation;

a first remaining powder separating unit operable to be supplied with the hulls separated in the oxidation unit, including a first brush for separating remaining powder adhered on an outer peripheral surface of the hulls;

a hull alignment unit operable to be supplied with the hulls from the first remaining powder separating unit, and to align the hulls;

a second remaining powder separating unit operable to be supplied with the aligned hulls from the hull alignment unit, including a second brush for separating remaining powder adhered on an inner peripheral surface of the hulls;

a third remaining powder separating unit operable to be supplied with the hulls from the second remaining powder separating unit, to separate the remaining powder remaining on the inner/outer peripheral surface of the hulls using air;

a hull receiving unit operable to receive the hulls transported from the third remaining powder separating unit;

a remaining powder receiving unit operable to receive the remaining powder separated from the hulls; and a high-temperature vacuum heating unit operable to be supplied with at least one of the pellet separated in the oxidation unit or the remaining powder received in the remaining powder receiving unit, and to heat the pellet or the remaining powder in a high temperature vacuum.

* * * * *